US010329966B1

(12) United States Patent
Rollinger et al.

(10) Patent No.: US 10,329,966 B1
(45) Date of Patent: Jun. 25, 2019

(54) VARIABLE CAM TIMING SYSTEM AND METHOD FOR OPERATION OF SAID SYSTEM

(71) Applicant: Ford Global Technologies, LLC, Dearborn, MI (US)

(72) Inventors: John Rollinger, Troy, MI (US); Jamie Hanshaw, South Lyon, MI (US); Adam Krach, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 5 days.

(21) Appl. No.: 15/849,287

(22) Filed: Dec. 20, 2017

(51) Int. Cl.
*F01L 1/344* (2006.01)
*F01L 1/02* (2006.01)

(52) U.S. Cl.
CPC ..... *F01L 1/34409* (2013.01); *F01L 1/022* (2013.01); *F01L 1/024* (2013.01); *F01L 2001/3443* (2013.01); *F01L 2001/34453* (2013.01); *F01L 2001/34483* (2013.01); *F01L 2201/00* (2013.01)

(58) Field of Classification Search
CPC ..... F01L 2001/0478; F01L 1/053; F01L 2001/186; F01L 1/267; F01L 1/34409; F01L 1/46
USPC ..... 123/90.17, 90.2, 90.27, 90.44
See application file for complete search history.

(56) References Cited

U.S. PATENT DOCUMENTS

| | | | | |
|---|---|---|---|---|
| 5,107,805 | A | 4/1992 | Butterfield et al. | |
| 7,255,077 | B2 | 8/2007 | Simpson et al. | |
| 2008/0078345 | A1 | 4/2008 | Knauf et al. | |
| 2009/0107434 | A1* | 4/2009 | Berger | F01L 1/047 123/90.31 |
| 2010/0211297 | A1 | 8/2010 | Doering et al. | |
| 2013/0206088 | A1 | 8/2013 | Wigsten | |
| 2016/0108767 | A1* | 4/2016 | Pietrzyk | F01L 1/344 123/90.17 |
| 2016/0108772 | A1 | 4/2016 | Pietrzyk et al. | |
| 2016/0108773 | A1 | 4/2016 | Rollinger et al. | |

* cited by examiner

*Primary Examiner* — Jorge L Leon, Jr.
(74) *Attorney, Agent, or Firm* — Julia Voutyras; McCoy Russell LLP

(57) ABSTRACT

A variable cam timing system in an engine is provided. The variable cam timing system includes a camshaft receiving rotational input from a crankshaft. The camshaft includes a valve cam rotationally actuating a valve coupled to a cylinder and a null cam actuating a null follower including a null spring exerting a return force on the null cam during interaction between the null cam and the null follower, where the null follower is independent from the cylinder.

18 Claims, 6 Drawing Sheets

VARIABLE CAM TIMING SYSTEM AND METHOD FOR OPERATION OF SAID SYSTEM

FIELD

The present description relates generally to a variable cam timing system and method for operating a variable cam timing system.

BACKGROUND/SUMMARY

Camshaft Torque Actuated (CTA) Variable Cam Timing (VCT) devices rely upon the camshaft torque caused by cylinder valve lift events to adjust the camshaft timing of an engine. When toque actuated cam phasers are used in conjunction with valve deactivation systems such valve lift may not occur, the resulting decrease or in some instances absence of camshaft torque may prevent reliable actuation of the camshaft phaser. As a result, desired camshaft timing adjustment may not be achieved during valve deactivation.

U.S. Pat. No. 7,255,077 discloses a cam phaser that adjusts the cam timing of a valve. However, if the cam phaser were to be used in conjunction with a valve deactivation device, the phaser may be rendered inoperable due to the reduction of cam torque. Consequently, both valve timing and valve deactivation could not be synchronously performed in such an engine, thereby reducing engine efficiency.

Recognizing the problems mentioned above and in an attempt to resolve at least some of the problems the inventors developed a variable cam timing system in an engine. The variable cam timing system includes a camshaft receiving rotational input from a crankshaft. The camshaft includes a valve cam rotationally actuating a valve coupled to a cylinder and a null cam actuating a null follower including a null spring exerting a return force on the null cam during interaction between the null cam and the null follower, where the null follower is independent from the cylinder. In this way, a follower that is not associated with valve actuation may be used to generate camshaft torque. As a result, a cam phaser coupled to the camshaft may be operated over a wider range of engine operating conditions thereby increasing engine efficiency.

Further in one example, the null follower may be selectively engaged and disengaged. For instance, the null follower may be activated responsive to deactivation of the valve. Consequently, the system's efficiency may be improved by providing additional camshaft torque only when desired to reduce losses caused by the interaction between the null cam and the null follower.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

A variable cam timing system that generates supplemental camshaft torque to enable a torque actuated cam phaser to be operated over a wider range of conditions is described herein. Operation of the cam phaser over the expanded range of conditions enables engine efficiency to be increased while reducing emissions. The variable cam timing system includes, in one example, a null cam rotationally coupled to a camshaft cyclically actuating a null follower that is independent of valve actuation. Thus, the null cam and the null follower are not associated with engine valve actuation and are spaced away from cylinder valves in the engine. The interaction between the null cam and the null follower generates camshaft torque which may be harnessed by a torque actuated cam phaser to adjust (e.g., advance or retard) valve timing. In one example, the variable cam timing system may include a null cam deactivation device designed to activate and deactivate the null follower to vary the amount of torque imparted on the camshaft via the null follower. For instance, the null follower may be activated in response to deactivation of an engine valve to increase camshaft torque. Resultantly, a desired amount of camshaft torque may be selectively generated to enable operation of a torque actuated cam phaser to adjust valve timing during periods of valve deactivation. In this way, camshaft torque can be regulated to facilitate operation of the torque actuated cam phaser to increase combustion efficiency and reduce emissions. Continuing with such an example, the null follower may be deactivated in response to reactivation of the engine valve, thereby reducing losses in the system caused by the interaction between the null cam and the null follower. In this way, the null cam and the null follower may be activated only when additional camshaft torque is needed to operate the cam phaser and may be deactivated when additional camshaft torque is not needed to operate the cam phaser. As a result, the efficiency of the variable cam timing system if further increased.

Figure 1:
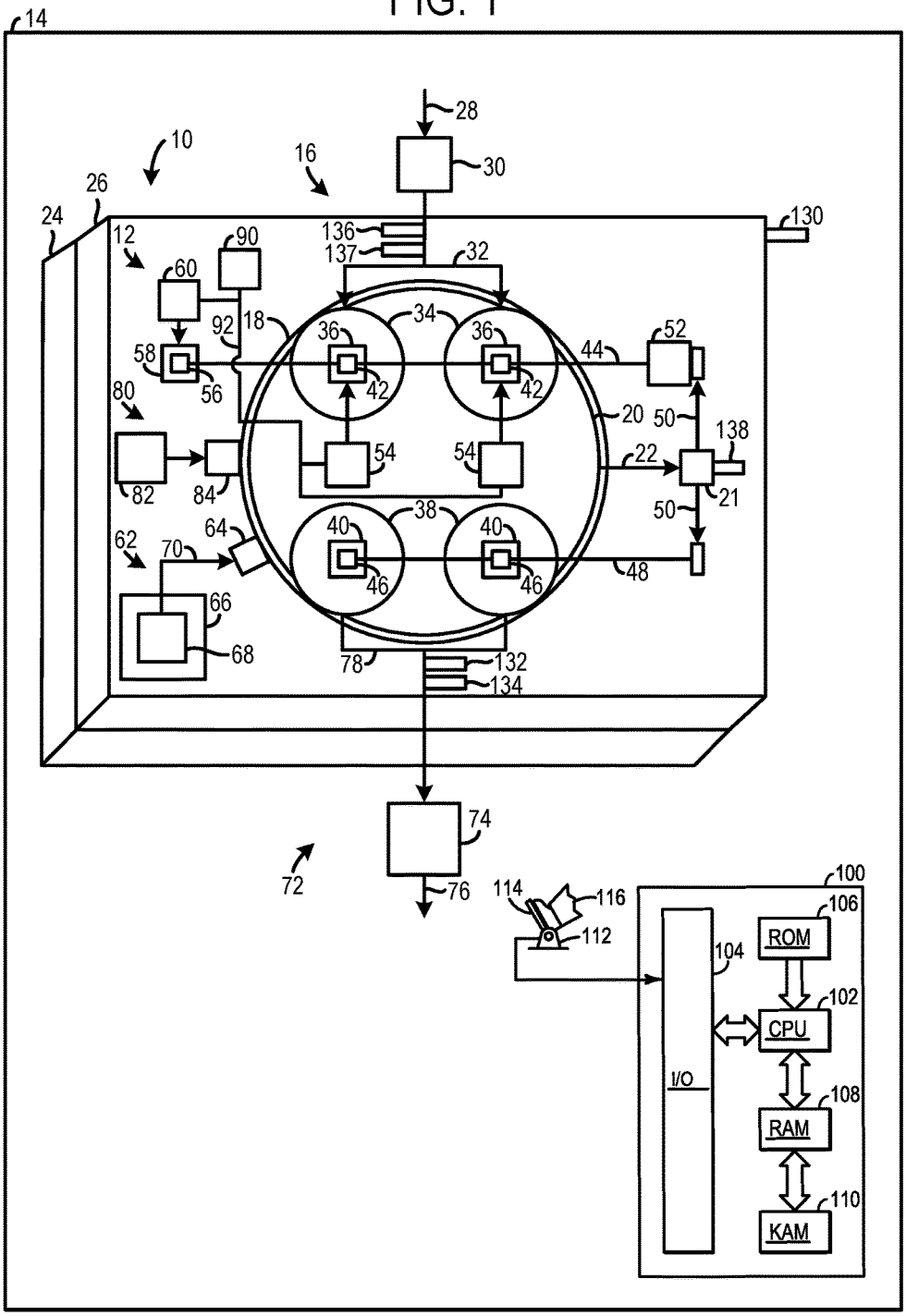
FIG. 1 shows a schematic depiction of an internal combustion engine including a variable cam timing system.
Figure 2:
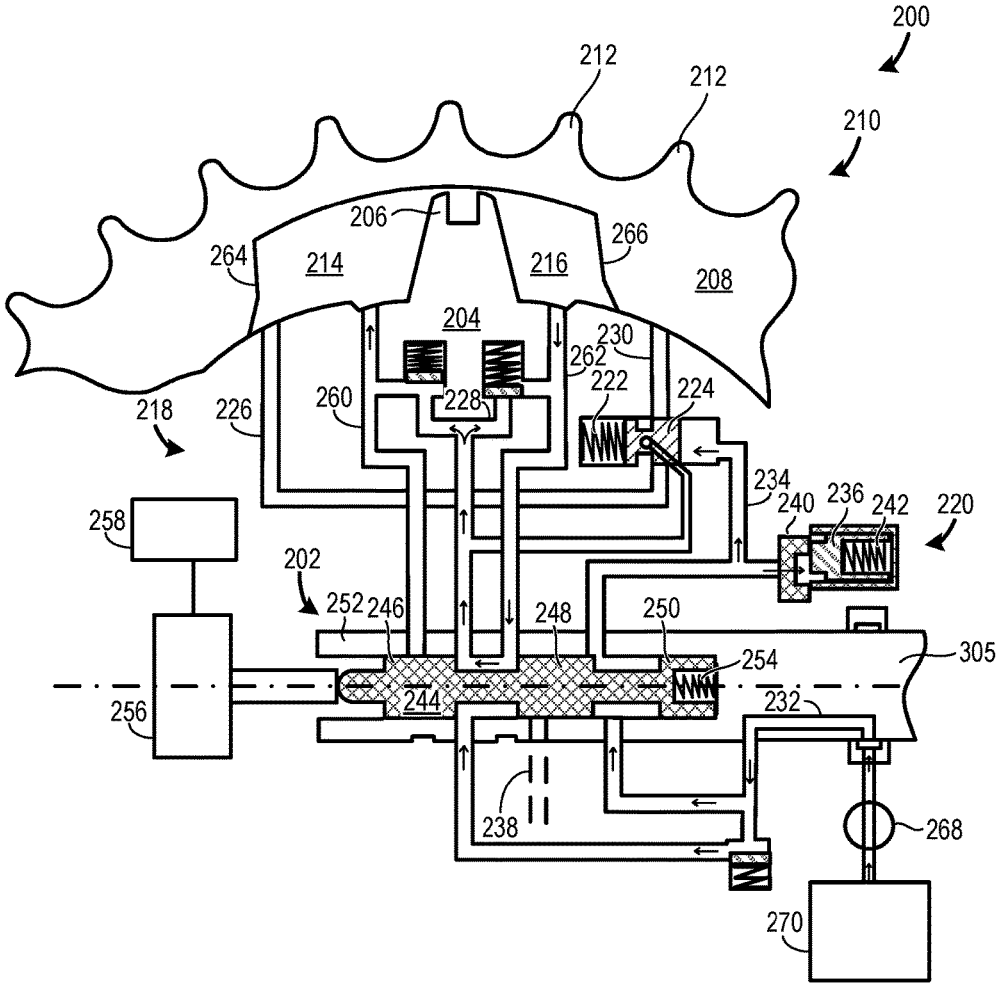
FIG. 2 shows an illustration of an exemplary torque actuated cam phaser.
Figure 3:
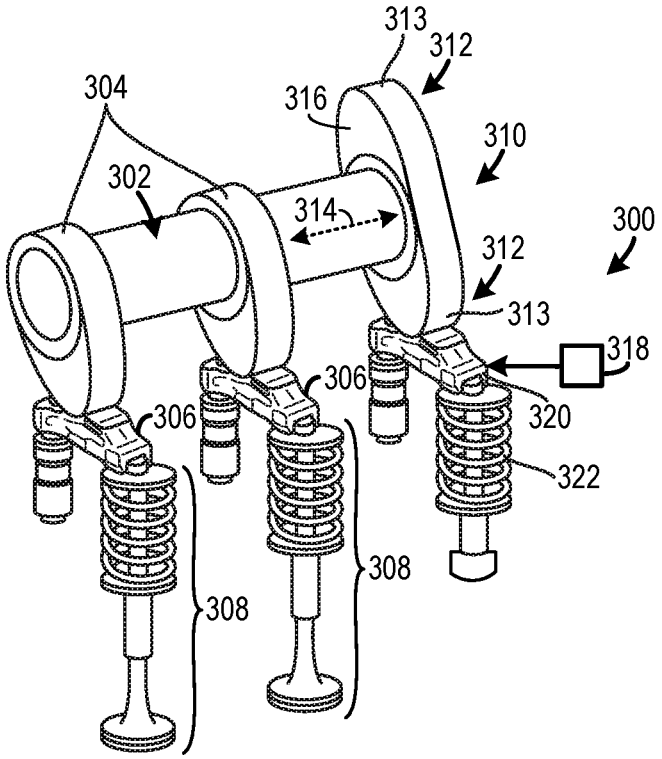
FIG. 3 shows an illustration of an exemplary variable cam timing system.
Figure 4:
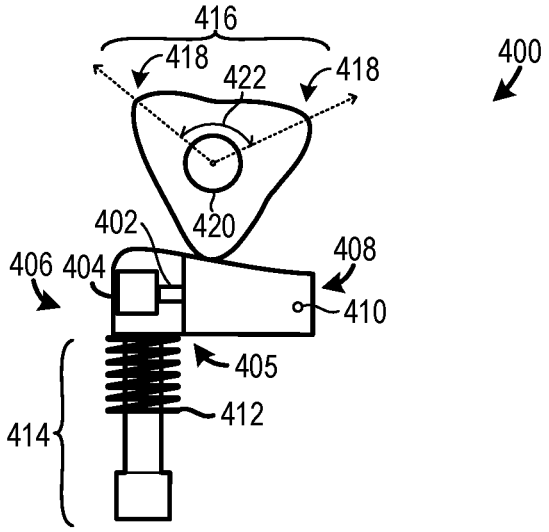
FIG. 4 shows a detailed view of a null cam deactivation device included in a variable cam timing system.
Figure 5:
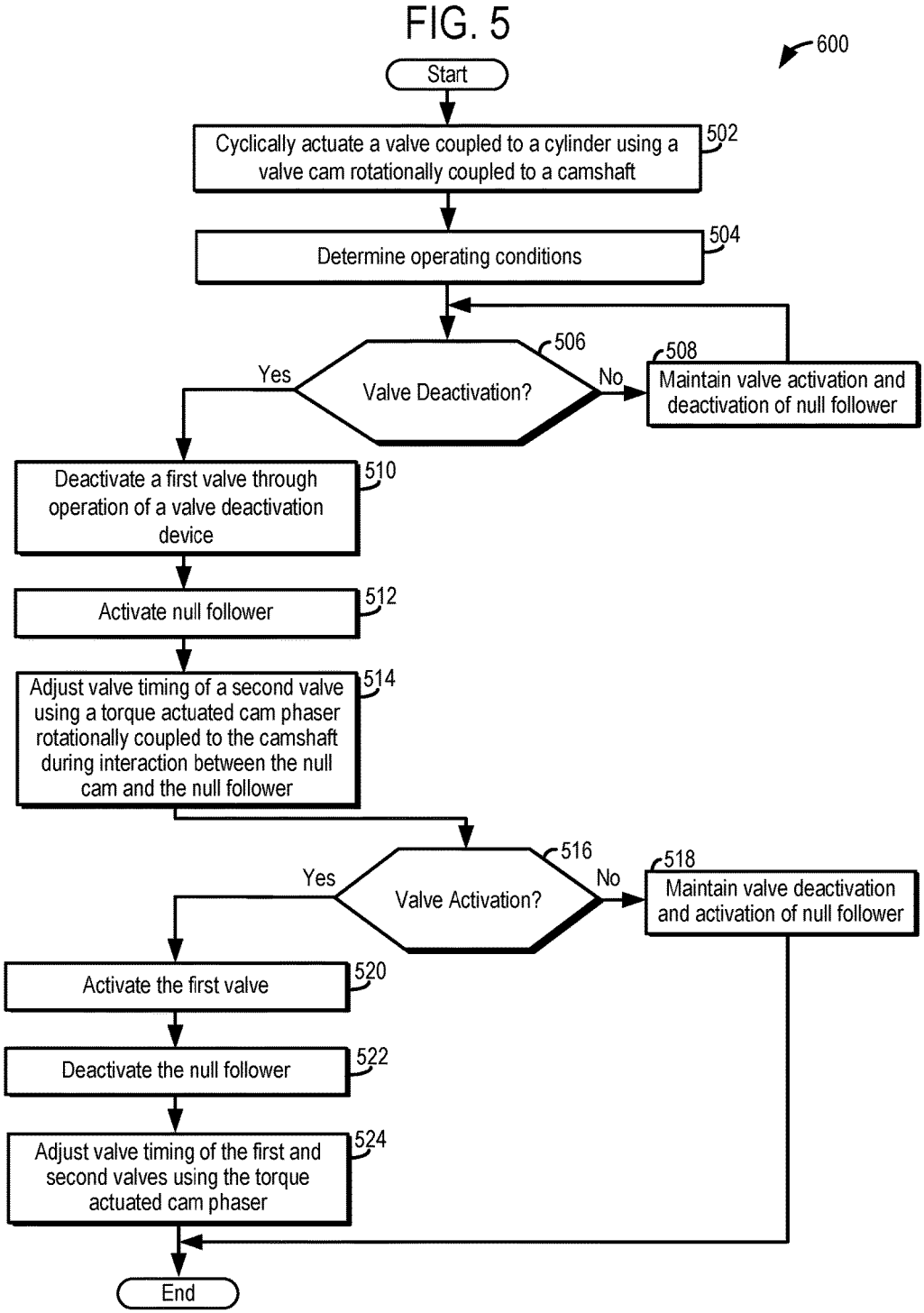
FIG. 5 shows a method for operating a variable cam timing system.
Figure 6:
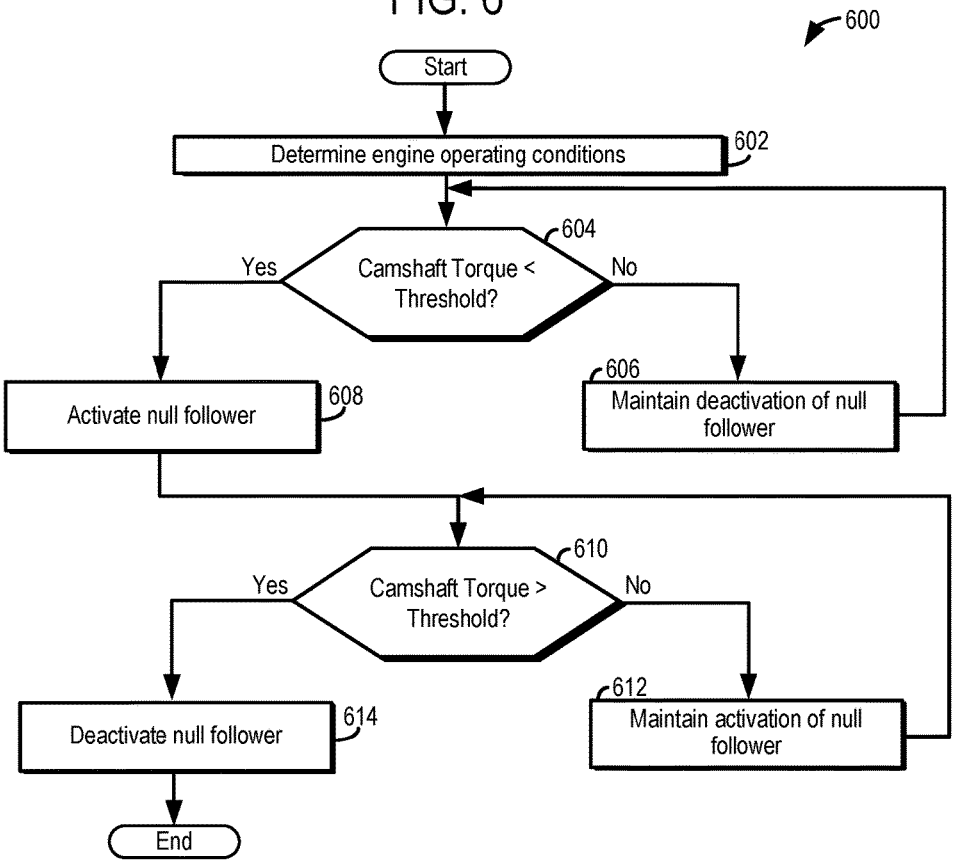
FIG. 6 shows another method for operating a variable cam timing system.
Figure 7:
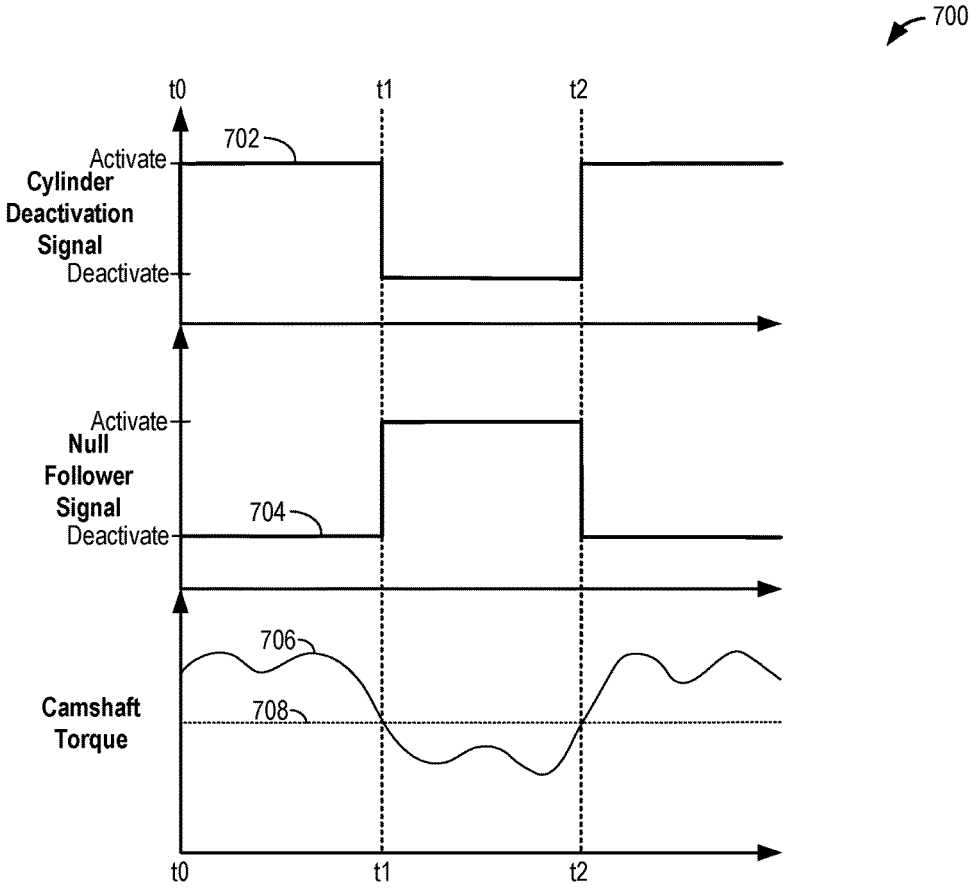
FIG. 7 shows a timing diagram of an exemplary variable cam timing system control strategy.

FIG. 1 shows a schematic depiction of an engine with a variable cam timing system. FIG. 2 shows an example of a torque actuated cam phaser that may be included in the engine shown in FIG. 1. FIGS. 3 and 4 show different example variable cam timing systems. FIGS. 5 and 6 show methods for operating a variable cam timing system. FIG. 7 show a graph illustrating plots and control signals associated with a method for operating a variable cam timing system.

Turning to FIG. 1, an engine 10 with a variable cam timing system 12 in a vehicle 14 is schematically illustrated. Although, FIG. 1 provides a schematic depiction of various engine and engine system, it will be appreciated that at least some of the components may have a different spatial positions and greater structural complexity than the components shown in FIG. 1. The structural details of the components are discussed in greater detail herein with regard to FIGS. 2-4.

An intake system 16 providing intake air to a cylinder 18, is also depicted in FIG. 1. A piston 20 is positioned in the cylinder 18. The piston 20 is coupled to a crankshaft 21 via a piston rod 22 and/or other suitable mechanical component. The cylinder 18 is formed by a cylinder block 24 coupled to a cylinder head 26. Although, FIG. 1 depicts the engine 10 with one combustion chamber. The engine 10 may have additional combustion chambers, in other examples. For instance, the engine 10 may include a plurality of combustion chambers which may in some instances be positioned in banks.

The intake system 16 includes an intake conduit 28 and a throttle 30 coupled to the intake conduit. The throttle 30 is configured to regulate the amount of airflow provided to the cylinder 18. In the depicted example, the intake conduit 28 feeds air to an intake manifold 32. In turn, the intake manifold 32 directs air to intake valves 34. The intake valves 34 open and close to allow intake airflow into the cylinder at desired time periods. Further in other examples, such as in a multi-cylinder engine additional intake runners may branch off of the intake manifold and feed intake air to other intake valves. It will be appreciated that the intake manifold 32 and the intake valves 34 are included in the intake system 16. Moreover, the engine shown in FIG. 1 includes two intake valves and two exhaust valves. However, in other examples the cylinder 18 may include a single intake valve and/or a single exhaust valve or more than two intake and/or exhaust valves. Additionally, the engine may include additional cylinders which may have a similar number of intake and/or exhaust valves or an alternative number of intake and/or exhaust valves.

The intake valves 34 are actuated by intake valve actuators 36. Likewise, exhaust valves 38 are actuated by exhaust valve actuators 40. The valve actuators may include springs, tappets, rocker arms, and/or other suitable components that enable valve opening and closing to occur in response to cam actuation of the actuator. The structural details of the valve actuators are discussed in greater detail herein with regard to FIGS. 3-4. Furthermore, it will be appreciated that the intake and exhaust valve actuators may include similar actuator components or in other examples may have different components that facilitate actuation.

The intake valve actuators 36 are activated by intake cams 42 rotationally coupled to an intake camshaft 44. Likewise, the exhaust valve actuators 40 are activated by exhaust cams 46 rotationally coupled to an exhaust camshaft 48. Both the intake and exhaust camshafts, 44 and 48 respectively, are coupled to the crankshaft 21, denoted via arrows 50. Chains, belts, and/or other mechanical components may facilitate the rotational connection between the camshafts and the crankshaft.

A torque actuated cam phaser 52 (e.g., torque actuated variable cam timing (VCT) phaser) is coupled to the intake camshaft 44. The torque actuated cam phaser 52 is designed to harness torque from the camshaft to induce phase adjustments of the camshaft to advance and retard valve timing. An example torque actuated phaser is shown in FIG. 2 and discussed in greater detail herein.

Intake valve deactivation devices 54 are also coupled to the intake valve actuators 36. The intake valve deactivation devices 54 are configured to independently activate and deactivate the intake valves. In one example, the intake valve deactivation devices may be delatchable roller finger followers (DRFF) that mechanically disconnect the valve from the camshaft when in cylinder deactivation mode. In one example, the delatchable roller finger followers may be similar to the null cam deactivation device described herein. Thus, both the intake valve deactivation devices and the null cam deactivation devices may utilize delatchable roller finger followers. In such an example, control actions may be taken to enable the intake valve deactivation devices receive a high oil pressure when the null lobe deactivation device receives low oil pressure or vice-versa. Oil pressure may be controlled through the use of electrically actuated oil control valves that control whether the roller finger follower is receiving high oil pressure and is therefore latched together or is receiving low or no oil pressure and is therefore unlatched. When the roller finger follower is latched together valve lift would occur normally. When the roller finger follower is unlatched it would not be possible for the camshaft lobe to impart a force on the valve and thus no valve lift would occur.

In FIG. 1 the intake valves have deactivation devices and a cam phaser. However, additionally or alternatively, the exhaust valve may have corresponding deactivation devices and cam phaser. Further in other examples, the valve deactivation devices may be used to activate and deactivate both intake and exhaust valves. Still further in other examples, the valve deactivation devices may be coupled to additional engine cylinders.

The variable cam timing system 12 is shown including a null cam 56 rotationally coupled to the intake camshaft 44. The variable cam timing system 12 also includes a null follower 58 interacting with the null cam 56 during camshaft rotation to generate torque on the camshaft. The null cam 56 and the null follower 58 are not associated with the cylinder 18. Thus, the null cam 56 and the null follower 58 may be spaced away and uncoupled from any of the valves corresponding to the cylinder 18 or other cylinders in the engine, in the case of a multi-cylinder engine. In this way, the null cam 56 and the null follower 58 may be independent from the cylinder 18. The null cam is provided to impart torque on the camshaft to enable the torque actuated cam phaser to operate as desired. For instance, when one or more of the intake valves 34 are deactivated the camshaft may not be provided with enough torque to enable the cam phaser that utilizes camshaft torque to function.

The variable cam timing system 12 may also include a null cam deactivation device 60 designed to activate and deactivate the null follower. Deactivation of the null follower includes moving the null follower into an inactive position that inhibits interaction between the null cam and the null follower during rotation of the camshaft to selectively generate camshaft torque which may be used to operate the torque actuated cam phaser. However, in other examples the variable cam timing system 12 may not include the null cam deactivation device. In such an example, the null cam and the null cam follower may continuously cyclically interact with one another during engine operation.

It will also be appreciated that the variable cam timing system 12 may also include the torque actuated cam phaser 52 and/or the valve deactivation devices 54. In the illustrated example, the variable cam timing system 12 includes an oil control valve 90 providing pressurized lubricant (e.g., oil) to the valve deactivation devices 54 as well as the null cam deactivation device 60 via oil lines 92. It will also be appreciated that another oil control valve may also provide pressurized lubricant to the torque actuated cam phaser 52. Still further in other examples, separate oil control valves may provide pressurized lubricant to the valve deactivation devices 54 and the null cam deactivation device 60. These oil control valves may be controller via the controller 100, discussed in greater detail herein. It will be appreciated that the oil pressure provided to the valve deactivation devices and the null cam deactivation device may trigger activation and deactivation of the devices. The oil control valve 90 is designed to regulate the amount and pressure of oil provided to the valve deactivation devices 54 and the null cam deactivation device 60 and therefore can initiate deactivation and activation the devices. It will be appreciated that the oil control valve 90 may receive lubricant from a lubricant pump and a lubricant reservoir, such as the lubricant pump 268 and the lubricant reservoir 270, shown in FIG. 2, discussed in greater detail herein. Further in other instances, the variable cam timing system 12 may include separate oil control valves and/or other actuators corresponding to the valve deactivation devices and the null cam deactivation device.

A fuel delivery system 62 is also shown in FIG. 1. The fuel delivery system 62 provides pressurized fuel to a fuel injector 64. In the illustrated example, the fuel injector 64 is a direct fuel injector coupled to cylinder 18. Additionally or alternatively, the fuel delivery system 62 may also include a port fuel injector designed to inject fuel upstream of the cylinder 18 into the intake system 16. The fuel delivery system 62 includes a fuel tank 66 and a fuel pump 68 designed flow pressurized fuel to downstream components. A fuel line 70 provides fluidic communication between the fuel pump 68 and the fuel injector 64. The fuel delivery system 62 may include conventional components such as a high pressure fuel pump, check valves, return lines, etc., to enable fuel to be provided to the injectors at desired pressures.

An exhaust system 72 configured to manage exhaust gas from the cylinder 18 is also included in the vehicle 14 depicted in FIG. 1. The exhaust system 72 includes the exhaust valves 38 designed to open and close to allow and inhibit exhaust gas flow to downstream components from the combustion chamber. The exhaust system 72 also includes an emission control device 74 coupled to an exhaust conduit 76 downstream of an exhaust manifold 78. The emission control device 74 may include filters, catalysts, absorbers, etc., for reducing tailpipe emissions. The engine 10 also includes an ignition system 80 (e.g., spark plug) including an energy storage device 82 designed to provide energy to an ignition device 84. Additionally or alternatively, the engine 10 may perform compression ignition.

During engine operation, the cylinder 18 typically undergoes a four stroke cycle including an intake stroke, compression stroke, expansion stroke, and exhaust stroke. During the intake stroke, generally, the exhaust valve closes and intake valve opens. Air is introduced into the combustion chamber via the corresponding intake conduit, and the piston moves to the bottom of the combustion chamber so as to increase the volume within the combustion chamber. The position at which the piston is near the bottom of the combustion chamber and at the end of its stroke (e.g., when the combustion chamber is at its largest volume) is typically referred to by those of skill in the art as bottom dead center (BDC). During the compression stroke, the intake valve and the exhaust valve are closed. The piston moves toward the cylinder head so as to compress the air within combustion chamber. The point at which the piston is at the end of its stroke and closest to the cylinder head (e.g., when the combustion chamber is at its smallest volume) is typically referred to by those of skill in the art as top dead center (TDC). In a process herein referred to as injection, fuel is introduced into the combustion chamber. In a process herein referred to as ignition, the injected fuel in the combustion chamber is ignited via a spark from an ignition device, resulting in combustion. However, in other examples, compression may be used to ignite the air fuel mixture in the combustion chamber. During the expansion stroke, the expanding gases push the piston back to BDC. A crankshaft converts this piston movement into a rotational torque of the rotary shaft. During the exhaust stroke, in a traditional design, exhaust valve is opened to release the residual combusted air-fuel mixture to the corresponding exhaust passages and the piston returns to TDC.

The engine 10 may also include an engine lubrication system (not shown). The engine lubrication system may include lubricant lines, valve, nozzles, etc., for delivering lubricant (e.g., oil) to lubricated components such as the piston, camshafts, crankshaft, etc. It will be appreciated that the oil control valve 90 and oil lines 92 may draw oil from the engine lubrication system.

FIG. 1 also shows a controller 100 in the vehicle 14. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 10. The sensors may include engine coolant temperature sensor 130, exhaust gas composition sensor 132, exhaust gas airflow sensor 134, an intake airflow sensor 136, manifold pressure sensor 137, engine speed sensor 138, etc. Additionally, the controller 100 is also configured to receive throttle position (TP) from a throttle position sensor 112 coupled to a pedal 114 actuated by an operator 116.

Additionally, the controller 100 may be configured to trigger one or more actuators and/or send commands to components. For instance, the controller 100 may trigger adjustment of the throttle 30, torque actuated cam phaser 52, valve deactivation devices 54, null cam deactivation device 60, fuel injector 64, etc. Specifically, the controller 100 may be configured to send signals to the null cam deactivation device 60 to activate and deactivate the null follower. The controller 100 may also be configured to send control signals to the valve deactivation devices 54 to activate and deactivate the intake valves 34. Furthermore, the controller 100 may be configured to send control signals to the fuel pump 68 and the fuel injector 64 to control the amount and timing of fuel injection provided to the cylinder 18. The controller 100 may also send control signals to the throttle 30 to vary engine speed.

Therefore, the controller 100 receives signals from the various sensors and employs the various actuators to adjust engine operation based on the received signals and instructions stored in memory (e.g., non-transitory memory) of the controller. Thus, it will be appreciated that the controller 100 may send and receive signals from the variable cam timing system 12. For example, adjusting the null cam deactivation device 60 may include device actuators to adjust components in the null cam deactivation device 60 to trigger null follower activation and deactivation. In yet another example, activating and deactivating the valve deactivation devices may include adjusting deactivator actuators that trigger valve activation or deactivation. In yet another example, the amount of component, device, actuator, etc., adjustment may be empirically determined and stored in predetermined lookup tables and/or functions. For example, one table may correspond to determining conditions when the null cam deactivation device 60 should activate the null follower and another table may correspond to determining conditions when the null cam deactivation device 60 should deactivate the null follower. In other examples, one table may correspond to conditions that trigger intake cam advancement via the phaser while another table may correspond to conditions that trigger intake cam retardation via the phaser. The tables may be indexed to engine operating conditions such as engine speed, engine load, among other engine operating conditions. Furthermore, the tables may output an amount of fuel to inject via the fuel injectors to the combustion chamber at each cylinder cycle. Thus, it will be appreciated that the controller 100 may be configured to implement the methods, control strategies, etc., described herein with regard to a variable cam timing system and engine.

In one example, the controller 100 may be configured to activate the null follower via the null cam deactivation device during a first operating condition and to deactivate the null follower during a second operating condition different from the first. For example, the first operating condition may include a condition where one or more of the intake valves is or are deactivated via one of the valve deactivation devices 54 and the second condition may include a condition where the intake valves are activated via the valve deactivation devices. In other examples, the null follower may be activated when the camshaft torque drops below a threshold value and deactivated when the camshaft torque rises above the threshold value. The threshold value (e.g., threshold camshaft phase rate) may be determined based on the number of valve lift events in an engine cycle. This characterization may allow for a comparison between a desired phase rate with a maximum achievable rate given the current number of available valve lift events. In one example, the null lobe spring may be activated when it is determined that the desired phase rate is greater than the maximum achievable rate. Additionally, in such an example the null lobe spring is inactive in situations where the remaining valve lift events are sufficient given the current desired phasing rate.

FIG. 2 shows an example torque actuated VCT phaser 200. Specifically, the VCT phaser 200 is in an advanced position in the illustrated example. The VCT phaser 200, shown in FIG. 2, is an example of the cam phaser 52 shown in FIG. 1. Therefore, the VCT phaser 200 may be included in the variable cam timing system 12 shown in FIG. 1.

A spool valve 202 is coupled to the VCT phaser. The spool valve 202 may be a solenoid operation spool valve, in one example. The spool valve 202 is shown positioned in an advance section of the spool. However, it will be appreciated that the spool valve may also be placed in a retarded configuration as well as other intermediate positions. Furthermore, the spool valve may be continuously adjusted. Additionally, the configuration of the spool valve sets the direction (e.g., advanced direction retarded direction) and rate of motion of the VCT phaser 200.

The VCT phaser 200 also includes a rotor 204 mounted to the end of a camshaft 205. The rotor 204 includes with one or more vanes 206. Additionally, the rotor 204 is surrounded by the housing assembly 208. The housing assembly 208 includes vane chambers 209 having the vanes 206 positioned therein. In another example, the vanes 206 may be included in the housing assembly 208 and the vane chambers 209 may be included in the rotor 204. The periphery 210 of the housing assembly 208 forms sprockets 212, pulleys, or gears accepting drive force through a chain, belt, or gears, usually from the crankshaft, or from another camshaft in a multiple-cam engine.

The VCT phaser 200 is designed as a cam torque actuated phaser. As such, torque reversals in the camshaft, caused by the forces of opening and closing engine valves, may assist in moving the vane 206. The advance and retard chambers, 214 and 216 respectively, may be arranged to resist positive and negative torque pulses in the camshaft 205. Furthermore, the advance and retard chambers, 214 and 216 respectively may alternatively be pressurized by cam torque. The spool valve 202 enables the vanes 206 in the phaser to move by permitting fluid flow from the advance chamber 214 to the retard chamber 216 or vice versa, depending on the desired direction of movement. For example, when it is desired to move the vanes in the advance direction, the spool valve 202 is adjusted to permit fluid flow from the retard chamber to the advance chamber. On the other hand, when it is desired to move the vanes in the retard direction, the spool valve 202 is adjusted to permit fluid flow from the advance chamber to the retard chamber.

The rotor 204 is connected to the camshaft 205 and is coaxially located within the housing assembly 208. It will be appreciated that the vanes 206 are designed to shift the relative angular position of the housing assembly 208 and the rotor 204. Additionally, FIG. 2 also illustrates a hydraulic detent circuit 218 and a locking pin circuit 220 are also present. The hydraulic detent circuit 218 and the locking pin circuit 220 are fluidly coupled. Thus, in one example the hydraulic detent circuit and the locking pin circuit may form a single hydraulic circuit. The hydraulic detent circuit 218 includes a spring 222 and a loaded pilot valve 224. The hydraulic detent circuit 218 also includes an advance detent line 226 that fluidly connects the advance chamber 214 to the pilot valve 224. The hydraulic detent circuit also includes a common line 228 and a retard detent line 230 hydraulically coupling the retard chamber 216 to the pilot valve 224 and the common line 228. The advance detent line 226 and the retard detent line 230 are a predetermined distance from the vanes 206. The pilot valve 224 is in the rotor 204 and is fluidly connected to the locking pin circuit 220 and supply line 232 through connecting line 234. The locking pin circuit 220 includes a locking pin 236, connecting line 234, the pilot valve 224, supply line 232, and exhaust line 238 (dashed lines).

The pilot valve may have two positions that may be adjusted therebetween. The first position may be a closed position and the second position may be an open position. The spool valve may trigger pilot valve adjustments into the two positions (i.e., open and closed). In the first position, the pilot valve is pressurized by engine generated oil pressure in line 234 positioning the pilot valve to substantially block (e.g., prevent) fluid from flowing between the advance and retard chambers through the pilot valve and the detent circuit 218. In the second position of the pilot valve, engine generated oil pressure in line 234 is absent. The absence of pressure in line 234 enables spring 222 to adjust the pilot valve so that fluid is allowed to flow between the detent line from the advance chamber and the detent line from the retard chamber through the pilot valve and a common line, such that the rotor assembly is moved to and held in the locking position.

The locking pin 236 is positioned in a bore in the rotor 204 and may slide therein. The locking pin 236 has an end portion that is biased towards and fits into a recess 240 in the housing assembly 208. A spring 242 enables the locking pin 236 to bias towards the recess 240. In other examples, the locking pin may be positioned in the housing assembly with the spring and the rotor 204 that may include the recess. It will be appreciated that opening and closing action in the hydraulic detent circuit 218 and pressurization of the locking pin circuit 220 are controlled by spool valve adjustment.

The spool valve 202 includes a spool 244 with cylindrical lands 246, 248, 250 positioned within a sleeve 252. In turn, the sleeve 252 is positioned within a bore of the rotor 204 and camshaft pilots. One end of the spool interacts with a spring 254. The other end of the spool interacts with a pulse width modulated variable force solenoid 256. The solenoid 256 may also be controlled by varying duty cycle, current, voltage and/or other techniques, in some instances. Furthermore, the spool 244 may be coupled to and/or include a motor and/or other actuators.

The spool's position is adjusted by interaction between the spring 254, solenoid 256, and a controller 258. The position of the spool 244 controls the motion (e.g., direction and rate of motion) of the phaser. For example, the position of the spool dictates whether the phaser is moved towards the advance position, towards a holding position, or towards the retard position. In addition, the position of the spool. Thus, the spool 244 may provide active pilot valve adjustment. Therefore, the spool valve 202 has an advance mode, a retard mode, a null mode, and a detent mode. These modes of control correspond to different spool valve positions. Specifically, particular regions of the spool valve's stroke may allow the spool valve to operate in the advance, retard, null, and detent modes.

In the advance mode, the spool 244 is moved to a position in the advance region of the spool valve allowing fluid to flow from the retard chamber 216 through the spool 244 on to the advance chamber 214, while fluid is blocked from exiting the advance chamber 214. In addition, the detent circuit 218 is held closed.

In the retard mode, the spool 244 is moved to the retard region of the spool valve, thereby enabling fluid to flow from the advance chamber 214 through the spool 244 and to the retard chamber 216, while fluid is blocked from exiting the retard chamber 216. Furthermore, the detent circuit 218 is held closed.

In the null mode, the spool 244 is moved to a position in the null region of the spool valve, thereby inhibiting fluid flow from the advance and retard chambers, 214 and 216 respectively, while continuing to hold the detent circuit 218 in a closed configuration. In the detent mode, the spool is moved to a position in the detent region. In the detent mode, three functions may occur at overlapping time intervals. The first function in the detent mode is that the spool 244 moves to a position in which spool land 248 blocks the flow of fluid from line 260 in between spool lands 246 and 248 from entering any of the other lines and line 262. In this way, control of the phaser is stopped. The second function in the detent mode may be a configuration where the detent circuit 218 is activated. As such, the detent circuit 218 has control over the phaser moving to advance or retard positions, until the vanes 206 reach an intermediate phase angle position. The third function in the detent mode is a mode where the locking pin circuit 220 is vented, allowing the locking pin 236 to mate with the recess 240. The intermediate phase angle position (e.g., mid-lock position or locked position) may include a position where the vanes 206 are between advance wall 264 and retard wall 266, the walls defining the chamber between the housing assembly 208 and the rotor 204. The locking position may be a position anywhere between the advance wall 264 and retard wall 266. The locking position may be set by a position of detent lines 226 and 230 in relation to the vanes 206. In particular, the position of detent lines 226 and 230 relative to the vanes 206 may include a position where neither passage may be exposed to advance and retard chambers 214 and 216. As a result, communication between the two chambers when the pilot valve is in the second position and the phasing circuit is suspended (e.g., disabled). Commanding the spool valve to the detent region may also be referred to herein as commanding a "hard lock".

Based on the duty cycle of the pulse width modulated variable force solenoid 256, the spool 244 moves to a corresponding position along its stroke. In one example, when the duty cycle of the variable force solenoid 256 is approximately 30%, 50%, or 100%, the spool 244 is moved to positions that correspond with the retard mode, the null mode, and the advance mode, respectively and the pilot valve 224 is pressurized and moved from the second position to the first position, while the hydraulic detent circuit 218 is closed, and the locking pin 236 is pressurized and released. In one example, when the duty cycle of the variable force solenoid 256 is set to 0%, the spool 244 is moved to the detent mode such that the pilot valve 224 vents and moves to the second position, the hydraulic detent circuit 218 is opened, and the locking pin 236 is vented and engaged with the recess 240. Choosing a duty cycle of 0% as the position along the spool stroke enables the hydraulic detent circuit 218 to open, the pilot valve 224 to be vented, and the locking pin 236 to be vented and engage with the recess 240. In the event that power or control is lost, the phaser may default to a locked position. It will be appreciated that the previously described duty cycle percentages are provided as non-limiting examples, and in alternate examples, numerous different duty cycles may be used to move the spool of the spool valve between the different spool regions. For example, the hydraulic detent circuit 218 may be opened and the pilot valve 224 may be vented while the locking pin 236 is engaged with the recess 240 at 100% duty cycle.

A lubricant pump 268 in fluidic communication with a lubricant reservoir 270 is also shown in FIG. 2. The lubricant pump 268 is in fluidic communication with the supply line 232. It will be appreciated that the lubricant pump 268 may also provide lubricant to other components in the engine such as the piston 20, crankshaft 21, etc., shown in FIG. 1. Thus, the lubricant pump 268 and the lubricant reservoir 270 may be included in a lubrication system. It will be appreciated that a variety of torque actuated cam phasers have been contemplated. For instance, in one example, cam torque actuated phasers may be used that have an end lock configuration meaning that the locked position is at one end of the range of travel (e.g., maximum range of travel). In another example, a cam torque actuated phaser that is mid locking may be used. Mid locking refers to the locked position being somewhere between the end positions. In yet another example, cam torque actuated phasers may be used that have oil pressure assist, meaning that either discrete chambers are assisted or all the chambers are assisted by oil pressure, in some instances.

FIG. 3 shows an example of a variable cam timing system 300. It will be appreciated that the variable cam timing system 300 shown in FIG. 3 is an example of the variable cam timing system 12, shown in FIG. 1. Moreover, the variable cam timing system 300 shown in FIG. 3 may also include the VCT phaser 200, shown in FIG. 2.

The variable cam timing system 300 includes a camshaft 302. The camshaft 302 is designed to receive rotational input from a crankshaft, such as the crankshaft 21, shown in FIG. 1. Additionally, the camshaft 302 includes valve cams 304 cyclically actuating valve actuators 306 cyclically actuating valves 308 during engine operation. The valves 308 may be coupled to separate cylinders, in one example. However, in other examples, the valves 308 may be coupled to a common cylinder.

The camshaft 302 also includes a null cam 310. The null cam 310 includes a plurality of lobes 312 with noses 313 extending away from a rotational axis 314 of the null cam and positioned on a common radial plane 316. Thus, each of the noses 313 may extend radially away from the rotational axis 314. However, in other examples the null cam 310 may include a single lobe, more than two lobes, etc.

The variable cam timing system 300 also includes a null cam deactivation device 318. The null cam deactivation device 318 is configured to activate and deactivate the null follower 320. It will be appreciated that when the null follower 320 is activated the follower cyclically interacts with the lobes 312 of the null cam 310. The null follower 320 includes a spring 322 and therefore when the null follower is cyclically actuated by the lobes 312 the null follower torques the camshaft 302.

FIG. 4 shows detailed view of an example null cam deactivation device 400. The null cam deactivation device 400 may be included in either of the variable cam timing systems, shown in FIGS. 1 and 3. The null cam deactivation device 400 includes a latch 402 and latch actuator 404. The latch 402 and latch actuator 404 are shown integrated into a first portion 405 of a null follower 406. The latch 402 may extend and retract to couple and uncouple the first portion 405 of the null follower 406 from a second portion 408 of the null follower 406. In this way, the null follower 406 may be activated and deactivated. The null follower 406 is also shown pivoting about a follower pivot 410. The null follower 406 also includes a spring 412 coupled to a null shaft 414 However, other null follower actuation kinematics have been contemplated. In one example, the null cam deactivation device 400 may be similar to the intake valve deactivation devices 54 shown in FIG. 1. Therefore, the null cam deactivation device may include a DRFF. In such an example, the null cam deactivation device 400 may include an electrically actuated oil control valve similar to the oil control valve discussed above with regard to the intake valve deactivation devices 54. Therefore, the oil pressure may determine whether the null cam deactivation device is latched, allowing for the null spring to impart a force on a camshaft, or unlatched, preventing the null spring from imparting force on the camshaft and reducing frictional losses as a result.

A null cam 416 is also shown in FIG. 4. In the illustrated example, the null cam 416 again includes multiple lobes 418. However, in other examples the null cam may include a single lobe or more than three lobes. The lobes 418 include noses radially extending away from a rotational axis of the camshaft 420. In this way, the null cam would impart torque on the camshaft multiple times per engine cycle.

The angles 422 formed between sequential lobes 418 are substantially equivalent, in the illustrated example. Specifically, the angles 422 formed between sequential lobes are each 120°. However, in other examples the angles formed between lobes may vary and/or may not be equal. The angular spacing between the null lobes may be unequal when the timing of cylinder lift events in one bank are not evenly spaced in the engine cycle. The null lobe may be designed to impart torque at the same points in engine revolution as the deactivated cylinders, in one example. In one use case scenario the camshaft is designed to control valve lift for four different cylinders. In this use case scenario two cylinders may be deactivated which may be the first and the last to lift in the engine cycle. As such, in the use case system the angular arrangement of the null lobes may be such that the lobes would meet at nearly a 90 degree angle, but then some amount of the shaft would have no lobe present and instead it would be at the base circle, so no torque would be imparted on the camshaft. However, numerous suitable lobe arrangements have been contemplated.

FIGS. 2-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

FIG. 5 shows a method 500 for operating a variable cam timing system in an engine. Method 500 as well as the other methods described herein may be implemented by the variable cam timing systems and engines described above with regard to FIGS. 1-4 or may be implemented by other suitable variable cam timing systems and engines, in other examples. Instructions for carrying out the method 500 and the other methods described herein may be executed by a controller based on instructions stored in memory (e.g., non-transitory) executable by the controller and in conjunction with signals received from sensors of in the engine and corresponding systems, such as the sensors described above with reference to FIGS. 1-4. The controller may employ engine actuators of the variable cam timing system and engine to adjust engine operation, according to the methods described below.

At 502 the method includes cyclically actuating a valve coupled to a cylinder using a valve cam rotationally coupled to a camshaft. Next at 504 the method includes determining operating conditions. The operating conditions may include engine speed, engine load, engine temperature, throttle position, manifold air pressure, exhaust gas composition, etc.

At 506 the method includes determining if a valve should be deactivated based on the operating conditions (e.g., engine speed and/or engine load). In one example, valve deactivation may be determined based on an engine speed and/or engine load threshold. For instance, a valve may be deactivated when engine speed is less than 3,000 RPM, 3,500 RPM, 4,000 RPM, etc. Further in one example, the deactivated valve may be coupled to a first cylinder and a valve coupled to a second cylinder may be activated. In another example, the deactivated valve may be coupled to a first cylinder and a second valve coupled to the first cylinder may be activated. If it is determined that the valve should not be deactivated (NO at 506) the method moves to 508. At 508 the method includes maintaining valve activation and null follower deactivation.

However, if it is determined that the valve should be deactivated (YES at 506) the method advances to 510. At 510 the method includes deactivating a first valve through operation of a valve deactivation device. For instance, a valve may be deactivated via oil pressure control. The oil pressure may be controlled through the use of an electrically actuated oil control valve. For instance, the valve may control oil pressure to the roller finger follower such that if a roller finger follower in the valve deactivation device is receiving high oil pressure the roller finger follower may be latched together and if the latch is receiving low or in some cases no pressure the roller finger follower may be unlatched. When the roller finger follower is latched together valve lift may occur normally. When the roller finger follower is unlatched it may not be possible for the camshaft lobe to impart a force on the valve and thus no valve lift would occur.

At 512 the method includes activating a null follower. Activating a null follower may include operating a null cam deactivation device to enable interaction between a null cam and the null follower to generate camshaft torque.

At 514 the method includes adjusting valve timing of a second valve using a torque actuated cam phaser rotationally coupled to the camshaft during interaction between the null cam and the null follower. In this way, the torque actuated cam phaser may be operated during periods of valve deactivation to increase combustion efficiency and reduce emissions. In one example, the second valve may be coupled to a different cylinder than the first valve. Further in such an example, the first and second valves may be either intake or exhaust valves. However, in other examples the first and second valves may be coupled to a common cylinder.

At 516 the method includes determining if the first valve should be activated. It will be appreciated that such a determination may take into account engine operating conditions such as engine speed and/or engine load. For instance, when the engine speed increases above a threshold value (e.g., 3,000 RPM, 3,500 RPM, 4,000 RPM, etc.,) it may be determined that the first valve should be activated. If it is determined that the first valve should not be activated (NO at 516) the method proceeds to 518. At 518 the method includes maintaining valve deactivation and activation of null follower.

However, if it is determined that the first valve should be activated (YES at 516) the method moves to 520. At 520 the method includes activating the first valve. Activating the first valve may include operating a valve deactivation device to enable the valve to cyclically open and close during combustion cycles.

At 522 the method includes deactivating the null follower. Deactivation of the null follower may include operating a null cam deactivation device to prevent interaction between the null follower and the null cam.

Next at 524 the method includes adjusting valve timing of the first and second valves using the torque actuated cam phaser. For instance, both the first and second valves may be correspondingly advanced or retarded. Method 500 enables the null follower to be activated and deactivated based on valve deactivation which enables the torque actuated cam phaser to be operated during valve deactivation, thereby increasing combustion efficiency and decreasing emissions.

FIG. 6 shows another method 600 for operating a variable cam timing system and an engine. The method 600 includes at 602 the method includes determining operating conditions. The operating conditions may include engine speed, engine load, engine temperature, valve activation state, camshaft torque, etc. In one example, camshaft torque may be calculated based on engine load and engine speed as well as valve activation state. In other examples, camshaft torque may be ascertained from a torque sensor coupled to the camshaft.

At 604 the method includes determining if camshaft torque is less than a threshold value. In one example, the threshold value may be determined based on the number of valve lift events in an engine cycle. For instance, the threshold camshaft phase rate may be a function of the number of valve lift events in an engine cycle. This characterization may allow for a comparison between the desired phase rate with the maximum achievable rate given the current number of available valve lift events. In one example, the null lobe spring may be activated when it is determined that the desired phase rate is greater than the maximum achievable, and ensures that the null lobe spring is inactive in situations where the remaining valve lift events are sufficient given the current desired phasing rate. If it is determined that the camshaft torque is not less than the threshold value (NO at 604) the method includes maintaining deactivation of a null follower at 606. On the other hand, if it is determined that the camshaft torque is less than the threshold value (YES at 604) the method moves to 608 where the method includes activating the null follower to enable interaction between the null follower and the null cam to generate camshaft torque. It will be appreciated that the camshaft torque may be used to operate a torque actuated cam phaser to advance or retard valve timing. It will also be appreciated that deactivation of one or more valves coupled to one or more cylinders in the engine while other valves in the engine are activated may create the decrease in camshaft torque.

At 610 the method includes determining if the camshaft torque is greater than the threshold value. If it is ascertained that the camshaft torque is not greater than the threshold value (NO at 610) the method proceeds to 612 where the method includes maintaining activation of the null follower. However, if it is determined that the camshaft torque is greater than the threshold value (YES at 610) the method moves to 614. At 614 the method includes deactivating the null follower to prevent interaction between the null cam and the null follower. In this way, the null cam follower can be deactivated to decrease energy losses in the variable cam timing system.

Now turning to FIG. 7, graphs 700 depict example variable cam timing system control signals in conjunction with a camshaft torque plot, such as described in FIGS. 1-6. The example of FIG. 7 is drawn substantially to scale, even though each and every point is not labeled with numerical values. As such, relative differences in timings can be estimated by the drawing dimensions. However, other relative timings may be used, if desired. Furthermore, each of the curves and plots time is represented on the x axis. It will also be appreciated that the plots in FIG. 7 are given as examples and that, in other examples, the timing of the control signals, the threshold values, etc., may vary.

Continuing with FIG. 7, graph 702 depicts the control signal sent to a valve deactivation device. Graph 704 indicates a control signal sent to the null cam deactivation device. Curve 706 depicts a camshaft torque curve. The control signals sent to the null cam deactivation device and the valve deactivation device both include two values (i.e., activate and deactivate).

At t1, the valve is switched from an activated configuration to a deactivated configuration. In response to valve deactivation the null follower is activated via the null cam deactivation device. At t1 the camshaft torque also falls below a threshold value 708. As previously discussed camshaft torque may additionally or alternatively be used as a trigger for null cam deactivation/activation. Further in some examples, the cam follower may be activated when multiple engine valves are deactivated.

At t2, the valve is switched from a deactivated configuration to an activated configuration. Responsive to the valve activation the null follower is deactivated via the null cam deactivation device. In this way, losses caused by interaction between the null follower and the null cam may be avoided when additional camshaft torque is not needed to assist in operation of the torque actuated cam phaser.

The technical effect of the variable cam timing systems and methods for operation of the variable cam timing systems described herein is the expansion of the operating window of the torque actuated cam phaser to include periods of valve deactivation. Consequently, both cam phasing and valve deactivation may be implemented in the engine, thereby increasing engine efficiency and reducing emissions.

The invention will further be described in the following paragraphs. In one aspect, a variable cam timing system in an engine is provided. The variable cam timing system includes a camshaft receiving rotational input from a crankshaft, the camshaft including a valve cam rotationally actuating a valve coupled to a cylinder, and a null cam actuating a null follower including a null spring exerting a return force on the null cam during interaction between the null cam and the null follower, where the null follower is independent from the cylinder.

In another aspect, a method for operation of a variable cam timing system is provided. The method includes cyclically actuating a valve coupled to a cylinder using a valve cam rotationally coupled to a camshaft, deactivating a valve through operation of a valve deactivation device, and responsive to deactivation of the valve, activating a null follower including a null spring exerting a return force on a null cam coupled to a crankshaft during interaction between the null cam and the null follower.

In another aspect, a variable cam timing system in an engine is provided. The variable cam timing system includes a camshaft receiving rotational input from a crankshaft, the camshaft including a valve cam lobe rotationally actuating a valve coupled to a cylinder, a null cam actuating a null follower including a null spring exerting a return force on the null cam during interaction between the null cam and the null follower, where the null follower is independent from the cylinder, and a torque actuated cam phaser rotationally coupled to the camshaft.

In any of the aspects herein or combinations of the aspects, the variable cam timing system may further include a null cam deactivation device designed to activate and deactivate the null follower, where deactivating the null follower including moving the null follower into an inactive position inhibiting interaction between the null cam and the null follower during rotation of the null cam.

In any of the aspects herein or combinations of the aspects, the variable cam timing system may further include a controller including code stored in memory executable by a processor to activate the null follower via the null cam deactivation device while a first operating condition is occurring.

In any of the aspects herein or combinations of the aspects, the first operating condition may include a condition where the valve is deactivated via a valve deactivation device coupled to the valve.

In any of the aspects herein or combinations of the aspects, the controller may further include code stored in memory executable by the processor to deactivate the null follower while a second operating condition is occurring.

In any of the aspects herein or combinations of the aspects, the second operating condition may include a condition where the valve is activated via the valve deactivation device.

In any of the aspects herein or combinations of the aspects, the variable cam timing system may further include a torque actuated cam phaser rotationally coupled to the camshaft.

In any of the aspects herein or combinations of the aspects, the torque actuated cam phaser may adjust cam timing during interaction between the null cam and the null follower.

In any of the aspects herein or combinations of the aspects, the null cam may include a plurality of noses extending away from a rotational axis of the null cam and actuating the null follower during rotation of the camshaft.

In any of the aspects herein or combinations of the aspects, the valve may be an intake valve.

In any of the aspects herein or combinations of the aspects, deactivating the valve may include operating an oil pressure control valve to deliver pressurized oil to the valve deactivation device to deactivate the valve and activating the null follower includes operating the oil pressure control valve to deliver the pressurized oil to activate the null follower.

In any of the aspects herein or combinations of the aspects, the method may further include activating the valve through operation of the valve deactivation device, and responsive to activation of the valve, deactivating the null follower to inhibit interaction between the null cam and the null follower.

In any of the aspects herein or combinations of the aspects, the null follower may be deactivated when camshaft torque decreases below a threshold value.

In any of the aspects herein or combinations of the aspects, the method may further include adjusting valve timing using a torque actuated cam phaser rotationally coupled to the camshaft during interaction between the null cam and the null follower.

In any of the aspects herein or combinations of the aspects, the variable cam timing system may further include a null cam deactivation device designed to activate and deactivate the null follower, where deactivating the null follower including moving the null follower into an inactive position inhibiting interaction between the null cam and the null follower during rotation of the null cam, and a controller including code stored in memory executable by a processor to activate the null follower via the null cam deactivation device while the valve is deactivated, the deactivation triggered by a valve deactivation device coupled to the valve.

In any of the aspects herein or combinations of the aspects, the controller may further include code stored in memory executable by the processor to deactivate the null follower while the valve is activated, the valve activation triggered by the valve deactivation device.

In any of the aspects herein or combinations of the aspects, the variable cam timing system may further include an oil control valve delivering pressurized oil to the valve deactivation device and the null cam deactivation device.

In any of the aspects herein or combinations of the aspects, the null cam may include a plurality of lobes with noses extending away from a rotational axis of the null cam and positioned on a common radial plane.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A variable cam timing system in an engine comprising:

a camshaft receiving rotational input from a crankshaft, the camshaft including:

a valve cam rotationally actuating a valve coupled to a cylinder;

a null cam actuating a null follower including a null spring exerting a return force on the null cam during interaction between the null cam and the null follower, where the null follower is independent from the cylinder; and a null cam deactivation device including a latch, the null cam deactivation device activates and deactivates the null follower, where deactivating the null follower includes moving the null follower into an inactive position inhibiting interaction between the null cam and the null follower during rotation of the null cam.

2. The variable cam timing system of claim 1, further comprising a controller including code stored in memory executable by a processor to activate the null follower via the null cam deactivation device while a first operating condition is occurring.

3. The variable cam timing system of claim 2, where the first operating condition includes a condition where the valve is deactivated via a valve deactivation device including a delatchable roller finger follower coupled to the valve.

4. The variable cam timing system of claim 3, where the controller further includes code stored in memory executable by the processor to deactivate the null follower while a second operating condition is occurring.

5. The variable cam timing system of claim 4, where the second operating condition includes a condition where the valve is activated via the valve deactivation device.

6. The variable cam timing system of claim 1, further comprising a torque actuated cam phaser rotationally coupled to the camshaft.

7. The variable cam timing system of claim 6, where the torque actuated cam phaser adjusts cam timing during interaction between the null cam and the null follower.

8. The variable cam timing system of claim 1, where the null cam includes a plurality of noses extending away from a rotational axis of the null cam and actuating the null follower during rotation of the camshaft.

9. The variable cam timing system of claim 1, where the valve is an intake valve.

10. A method for operation of a variable cam timing system comprising:

cyclically actuating a valve coupled to a cylinder using a valve cam rotationally coupled to a camshaft;

deactivating the valve through operation of a valve deactivation device including a delatchable roller finger follower; and responsive to deactivation of the valve, activating a null follower including a null spring exerting a return force on a null cam coupled to the camshaft during interaction between the null cam and the null follower.

11. The method of claim 10, where deactivating the valve includes operating an oil pressure control valve to deliver pressurized oil to the valve deactivation device and activating the null follower includes operating the oil pressure control valve to deliver the pressurized oil to a null cam deactivation device that includes a latch.

12. The method of claim 10, further comprising:

activating the valve through operation of the valve deactivation device; and responsive to activation of the valve, deactivating the null follower to inhibit interaction between the null cam and the null follower.

13. The method of claim 10, where the null follower is deactivated when camshaft torque decreases below a threshold value.

14. The method of claim 10, further comprising adjusting valve timing using a torque actuated cam phaser rotationally coupled to the camshaft during interaction between the null cam and the null follower.

15. A variable cam timing system in an engine comprising:

a camshaft receiving rotational input from a crankshaft, the camshaft including:

a valve cam lobe rotationally actuating a valve coupled to a cylinder;

a null cam actuating a null follower including a null spring exerting a return force on the null cam during interaction between the null cam and the null follower, where the null follower is independent from the cylinder;

a null cam deactivation device including a latch, the null cam deactivation device activating and deactivating the null follower, where deactivating the null follower includes moving the null follower into an inactive position inhibiting interaction between the null cam and the null follower during rotation of the null cam;

a torque actuated cam phaser rotationally coupled to the camshaft; and a controller including code stored in memory executable by a processor to activate the null follower via the null cam deactivation device while the valve is deactivated, the deactivation triggered via a valve deactivation device including a delatchable roller finger follower coupled to the valve.

16. The variable cam timing system of claim 15, where the controller further includes code stored in memory executable by the processor to deactivate the null follower while the valve is activated, the valve activation triggered by the valve deactivation device.

17. The variable cam timing system of claim 15, further comprising an oil control valve delivering pressurized oil to the valve deactivation device and the null cam deactivation device.

18. The variable cam timing system of claim 15, where the null cam includes a plurality of lobes with noses extending away from a rotational axis of the null cam and positioned on a common radial plane.

* * * * *